US009399979B2

(12) United States Patent
Heise et al.

(10) Patent No.: US 9,399,979 B2
(45) Date of Patent: Jul. 26, 2016

(54) IGNITION SYSTEM

(71) Applicant: DELPHI TECHNOLOGIES, INC., Troy, MI (US)

(72) Inventors: Volker Heise, Trier (DE); Marco Loenarz, Esch/Alzette (LU); Frank Lorenz, Alflen (DE)

(73) Assignee: Delphi Automotive Systems Luxembourg SA, Luxembourg (LU)

( * ) Notice: Subject to any disclaimer, the term of this patent is extended or adjusted under 35 U.S.C. 154(b) by 137 days.

(21) Appl. No.: 14/384,785

(22) PCT Filed: Mar. 18, 2013

(86) PCT No.: PCT/EP2013/055551
§ 371 (c)(1),
(2) Date: Sep. 12, 2014

(87) PCT Pub. No.: WO2013/135907
PCT Pub. Date: Sep. 19, 2013

(65) Prior Publication Data

US 2015/0034059 A1 Feb. 5, 2015

(30) Foreign Application Priority Data

Mar. 16, 2012 (EP) ..... 12159912

(51) Int. Cl.
*F02P 15/10* (2006.01)
*F02P 3/04* (2006.01)
(Continued)

(52) U.S. Cl.
CPC ..... *F02P 3/0407* (2013.01); *F02P 3/0442* (2013.01); *F02P 3/055* (2013.01); *F02P 9/002* (2013.01); *F02P 9/007* (2013.01); *F02P 15/10* (2013.01); *F02P 15/12* (2013.01); *F02P 2017/121* (2013.01)

(58) Field of Classification Search
CPC ..... F02P 9/002; F02P 15/10; F02P 15/12
USPC ..... 123/605, 620–622, 637
See application file for complete search history.

(56) References Cited

U.S. PATENT DOCUMENTS 3,280,809 A 10/1966 Issler
4,114,581 A * 9/1978 Wurst ..... F02P 3/0838 123/621

(Continued)

FOREIGN PATENT DOCUMENTS

CN 101292404 A1 10/2008
EP 2141352 A1 6/2010

OTHER PUBLICATIONS

International Search Report, Jun. 12, 2013, PCT/EP2013/055551.

*Primary Examiner* — Erick Solis
(74) *Attorney, Agent, or Firm* — Joshua M. Haines

(57) ABSTRACT

An ignition system for an internal combustion engine includes an ignition transformer with two primary windings. The ignition system is designed to generate, for a given ignition event, a unipolar current through the secondary winding by way of a control circuit that is configured to first energize and deenergize the first primary winding to establish a first electrical arc across the spark-plug electrodes and, when the current in the secondary winding reaches, or drops below, a current threshold, repeatedly energizes and deenergizes the second primary winding to establish a plurality of second current pulses across the electrodes in order to maintain the burn phase.

18 Claims, 2 Drawing Sheets

(51) Int. Cl.

| | |
|---|---|
| ***F02P 15/12*** | (2006.01) |
| ***F02P 9/00*** | (2006.01) |
| ***F02P 3/055*** | (2006.01) |
| *F02P 17/12* | (2006.01) |

(56) References Cited

U.S. PATENT DOCUMENTS 4,702,221 A 10/1987 Tokura et al.
4,770,152 A * 9/1988 Mogi ..... F02P 7/035 123/621
4,947,821 A * 8/1990 Somiya ..... F02P 3/005 123/606
5,806,504 A * 9/1998 French ..... F02P 9/007 123/605
5,886,476 A * 3/1999 Skinner ..... F02P 17/12 123/621
7,121,270 B1 10/2006 Plotnikov
7,681,562 B2 * 3/2010 Boerjes ..... F02P 3/053 123/595
2005/0000502 A1 * 1/2005 Waters ..... F02P 3/051 123/620

* cited by examiner

IGNITION SYSTEM

FIELD OF THE INVENTION

The present invention generally relates to an ignition system for an internal combustion engine and more particularly to an ignition system comprising an ignition transformer with two primary windings.

BACKGROUND OF THE INVENTION

The combustion of gasoline in reciprocal engines requires, as it is well known, a flame initiation device commonly called an ignition system. An ignition systems consists of two main components:

a spark plug; and an ignition coil or transformer.

The spark plug represents the direct interface to the flame kernel itself via its firing face and represents an isolated electrical feed-through into the combustion chamber. The task of the ignition transformer is to provide the suitably shaped energy to initiate the combustion. This is conventionally split into two consecutive and distinct phases.

The first phase stores electrical energy inside the inductors of the transformer and the next phase releases the previous stored energy. The transition itself creates a sufficient overvoltage at the spark-plug firing face, which allows initiating a dielectric break down and thereby changes significantly the electrical properties of the load of such electrical network. Because of the change in load the remaining stored energy undergoes depletion into the dielectric break down providing the spark. This ultimately creates the desired shockwave, radicals and heat and thereby, if well surrounded by combustible gasoline mixtures, a flame kernel, which in consequence will initiate the combustion.

For operating with lean gasoline mixtures, the common ignition systems fail (or limit the lean operation) because of the typical discharge nature of the stored energy to the load interaction. The depletion of the remaining stored energy of the transformer into the spark, which itself interacts heavily with its surroundings in the combustion chamber, creates unpredictable load situations. Accordingly, unpredictable heat amounts are delivered, in particular at unfavorable timings and unexpected locations. This consequently tends to result in statistical scattering of the combustion pressure, which contributes to unfavorable engine-out emissions as well as uncontrollability also referred to as instability of the combustion.

To a certain extent this malfunction is caused by the depletion of the energy of the transformer, thus the collapsing of the delivered electrical power into the spark.

The conventional solution to this is to simply increase the amount of energy stored in the transformer. Many higher energy coils are on the market and help solving the problem.

Other technical solutions are multi-charge ignition (MCI) systems. MCI systems are simply based on multiple repetitions of the aforementioned two consecutive distinct phases. A transformer comprises one primary winding magnetically coupled to one secondary winding. For one combustion event, the primary winding is repetitively energized and disenergized to create the series of sparks. These systems deliver over time several individual sparks in respect of one combustion event of a combustion cycle. The advantage is that more heat is disposed over a longer time, but not continuously. There are still combustion events when no spark-heat occurs while most suitable combustible mixtures are present. This is leading occasionally to very timely tight stable combustion situations, were smallest disturbances create increased pressure scatter traces and thereby lead to unstable lean operation conditions.

EP 2 325 476 discloses a multi-charge ignition system comprising two transformers that are operated alternately to maintain a burn phase.

EP 2 141 352 describes an ignition system with a dual primary coil, wherein the primary windings are alternately energized and deenergized, the first primary winding being reenergized whilst the second primary winding is deenergized, etc., whereby it is possible to successively cycle between an arc generated by the first primary winding and an arc generated by the second primary winding. A practical problem of this system is however the alternating polarities of the current in the secondary winding, which prevents the use of a diode in the line leading from the secondary winding terminal to the spark plug. Absent such diode, it is not possible to prevent a so-called "early make" spark, which typically occurs at the moment the primary coil is switched to the power source to start the charging phase. The occurrence of early make spark triggers ignition at undesired timings at low engine pressure.

U.S. Pat. No. 3,280,809 describes an ignition system of complex design, featuring a transformer having 3 primary windings and 1 secondary winding. The burn phase is maintained by alternating between two primary windings, and an alternating output current is produced.

OBJECT OF THE INVENTION

The object of the present invention is to provide an improved ignition system that is capable of operating a continuous burn.

SUMMARY OF THE INVENTION

This object is achieved by an ignition system as claimed in claim 1.

The ignition system according to the present invention has a secondary winding with a pair of output terminals coupled to gapped electrodes; as well as a pair of primary windings (LP1, LP2), which are inductively coupled to the secondary winding (LSEC).

It shall be appreciated that the ignition system is designed to generate, for a given ignition event, a current through the secondary winding by way of a control circuit that is configured to first—in an initial phase—energize and deenergize the first primary winding (LP1) to establish a first electrical arc across the gapped electrodes (initial phase) and, when the current in the secondary winding reaches, or drops below, a predetermined current threshold—in a second phase—repeatedly energize and deenergize the second primary winding (LP2) to establish a plurality of second electrical current pulses into the existing arc across the gapped electrodes in order to maintain the burn phase. This mode of operation allows the generation of current pulses in a time sequence such that the second phase can be maintained infinitely. An extended burn phase can thus be obtained without the need for a new dielectric break down.

A further advantage of this mode of operation is that a uni-polar current is generated at the output; the current through the secondary winding has the same polarity in the initial phase and in the second phase.

The LP1/LSEC pair provides the charge and initial burn of the spark event. The LP2/LSEC pair is active in the second phase, which is triggered in function of the current in the secondary winding (when the threshold condition is met), and provides a continuous burn phase, hence creating a continuous spark. The second phase is thus initiated during the initial arc, and preferably pushes power peaks into the latter in order to provide a pulsed supply of energy into the burn process. Moreover, in case the energy originating from the LP1/LSEC pair is depleted the burn process continues. This is possible because sufficient afterglow exists between the electrode gaps for a short time period after one single current pulse. In other words, the present invention exploits the existing afterglow to provide the continuous burn.

Overall, an efficient ignition system is proposed, providing a unipolar current with a reliable and simple design, requiring only one transformer with two primary windings coupled to one secondary winding.

By contrast to the ignition system of EP 2 141 352, the present ignition system is thus configured and operated so that the energy transferred into the secondary winding results in a unipolar current into the spark-plug and unipolar voltage across the spark-plug electrodes. This makes it possible to use a diode in series with the secondary coil and spark plug to prevent early make.

Another noticeable difference with the system of EP 2 141 352 is that the in the present invention the first primary winding is only operated once per combustion cycle (for the respective ignition event) during the initial phase in order to create the first electrical arc. After this arc has been created and the secondary current meets the secondary current threshold, the energy is further transferred to the secondary winding only by means of the second primary winding (operated a plurality of times). This contrasts with the system of EP 2 141 352, which always operates a toggling between the two primary windings, which are used in strict alternance over the ignition event.

Current measurement may be achieved by a current measuring shunt in series with the secondary winding.

Preferably, the turns ratio of the secondary winding to the second primary winding is larger than 150, more preferably between 200 and 500. The turns ratio of the secondary winding to the first primary winding may be in the range of 50 to 200.

The repeated energizing and deenergizing of the second primary winding (second phase) is advantageously driven by a pulse width modulation (PWM) signal, which is enabled when the threshold condition on the secondary current is met. This allows a reduction of thermal losses inside the transformer and associated electronics.

Each OFF-time of the PWM is preferably minimized to allow a continuous burn phase without the need for a new dielectric break down, hence creating a continuous spark. Conversely, each ON-time is preferably extended to maximize the energy transfer into the secondary winding at acceptable efficiency.

In practice, the ON-time may vary between 5 and 500 μs and/or the OFF-time may vary between 5 and 50 μs. If desired, the ON and OFF times of the PWM may vary during one single spark event.

Energizing and deenergizing of the primary windings is typically achieved by closing/opening respective switching devices (e.g. IGBT or like switching device) operated by the control circuit. The latter may optionally be protected under reverse current by diodes mounted in series.

According to another aspect of the invention, a method of providing ignition to an internal combustion engine is proposed.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
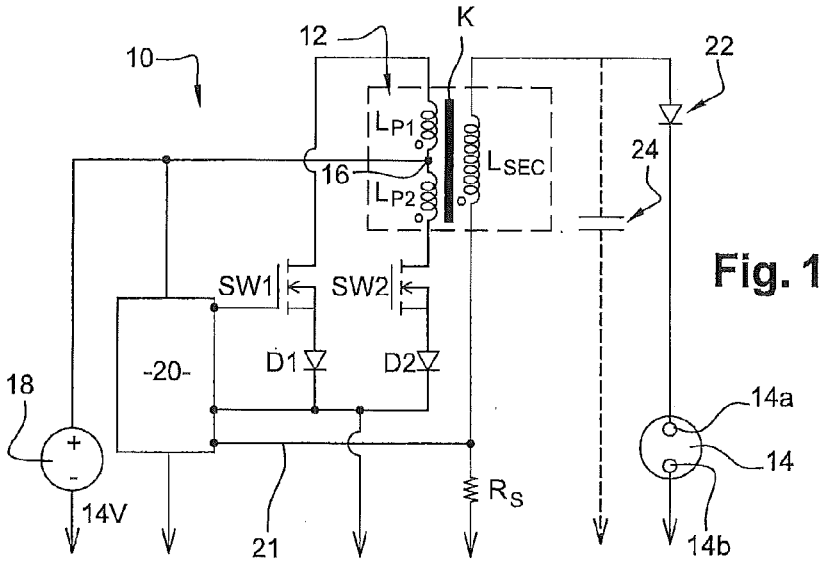
FIG. 1: is an electrical schematic diagram of an embodiment of the present ignition system.

With reference to FIG. 1, a preferred embodiment of the present ignition system 10 is shown in electrical schematic, comprising a dual primary winding ignition transformer 12, or ignition coil, servicing a single set of gapped electrodes 14*a* and 14*b* in a spark plug 14 such as might be associated with one combustion cylinder of an internal combustion engine (not shown).

In addition to the two primary windings noted LP1 and LP2, ignition coil 12 comprises a secondary winding LSEC and a common magnetic coupling K1; the three windings are magnetically coupled.

The system 10 is configured so that the two ends of the first and second primary windings LP1, LP2 may be switched, in an alternative manner, to a common ground such as a chassis ground of an automobile by electrical switches SW1, SW2. The switches SW1 and SW2 may each take the form of an IGBT (insulated gate bipolar transistor) or other appropriate semiconductor-switching device.

Preferably, the turn ratio of the secondary winding LSEC to the second primary winding LP2 is larger than 150; that is there are about 150 on secondary LSEC for one turn on the second primary winding LP2. As regards LP1, the system is preferably designed so that the delivered energy of LP1/LSEC into a single spark is similar to existing, conventional spark ignition systems or multi-spark ignition systems. In practice, the turns ratio of the secondary winding LSEC to the second primary winding LP1 may be in the range of 50 to 200.

Preferably, the turns ratio LSEC/LP2 is however in the range 200 to 500, and higher than the turns ratio LSEC/LP1.

As it will be understood by those skilled in the art, such turns ratio are adapted for operation with a conventional direct power source of 12-14 V. Operating at higher voltages, as e.g. possible on hybrid cars, would allow reducing the turns ratio.

In the present embodiment for extended burn applications, it is assumed that the low-voltage end of the secondary winding LSEC is coupled to a common ground or chassis ground of an automobile in conventional fashion. In application to plasma induced misfire detection, the low-voltage end could be, for example, coupled to ground through a tuned resonant network (not shown) adapted to detect the presence of certain frequency content in the secondary winding indicative of combustion in the cylinder.

The high-voltage end of the secondary ignition winding LSEC is, in turn, coupled to one electrode 14*a* of the gapped pair of electrodes in spark plug 14 through conventional means. The other electrode of the spark plug 14 is also coupled to the common ground, conventionally by way of threaded engagement of the spark plug to the engine block.

A coil tap 16 separates the two primary windings LP1 and LP2 and allows their connection to a common energizing potential, such as e.g. a conventional automotive system voltage in a nominal 12V or 14V automotive electrical system, represented in FIG. 1 as the positive voltage of a battery 18.

It may be noticed that the two primary windings LP1 and LP2 are preferably wound in the same direction, as indicated in FIG. 1. The centre tap 16 together with the same direction winding pattern produces the desired magnetic polarity through the magnetic circuit. In fact, the winding orientation of LP1/LSEC and LP2/LSEC, and the electrical connections, are realized such that the energy transferred into LSEC from both primary windings results in a uni-polar current into the spark-plug and uni-polar voltage across the spark-plug electrodes.

Current inductor sensing may be accomplished by means of a small resistor (shunt) RS that is serially arranged in the line connecting the secondary LSEC to the common ground. The voltage across shunt RS is a function of the current ISEC though the secondary winding LSEC. This voltage is fed to the control circuit 20 via line 21 for control purposes, as explained below.

The charge current is supervised by electronic control circuit 20 that controls the state of the switches SW1, SW2 in accordance with the present ignition procedure. For operation on a convention engine, the control circuit 20 may be responsive to so-called "electronic spark timing" (EST) to coordinate the control of the primary windings LP1 and LP2 via switches SW1 and SW2 in order to provide desired sparks.

As it is known to those skilled in the art, EST signals provide a conventional ignition timing control information from, for example, a conventional microprocessor engine control unit responsive to well-known engine parameters for controlling engine functions including, in addition to ignition functions, engine fuelling, exhaust emissions and diagnostics. EST signals are well understood to set dwell duration and spark timing relative to cylinder stroke angle. Such microprocessor-based controllers are also conventionally integrated with electronic transmission control functions to complete an integrated approach to powertrain control. Alternatively, some of the functions including ignition timing may be offloaded from the central engine controller and incorporated into the ignition system. In such a latter case, the EST signals, as well as other ignition control signals, particularly cylinder selection signals where appropriate, would be implemented by the separate ignition system.

Figure 2:
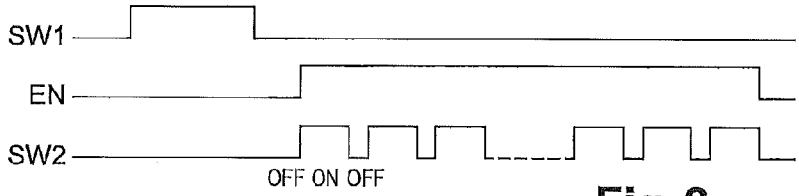
FIG. 2: is a logic diagram showing the operation of the switches SW1 and SW2.

Referring now more specifically to the present embodiment, control circuit 20 is configured to provide the following operational procedure to perform an ignition event required for one combustion cycle of one cylinder of an internal combustion engine. One ignition event (or cycle) starts by charging the first primary winding LP1. The pair LP1/LSEC represents the conventional ignition and provides the first, initial phase storing energy in the transformer 12, this by closing the switch SW1 such that a current can flow out of the battery (ON-state of SW1 is shown in FIG. 2). The start of the ignition event, respectively of the energizing of the first primary LP1 and the duration of the charge/dwell is preferably based on conventional EST, as explained above. At expiry of the predetermined dwell-time through the first primary LP1, the current therein is interrupted to cause initiation of a first arc across the gapped electrodes. Indeed, by releasing (opening) the switch SW1 the transition into the dielectric-break-down is initiated, which leads to the depletion of the energy from the secondary winding LSEC.

As the energy is depleted from the secondary LSEC, the control circuit 20 monitors the secondary current ISEC by way of the voltage across shunt RS. As soon as the secondary current ISEC drops below a threshold value ISEC_TH the control circuit 20 operates a second phase, which comprises repeatedly energizing and deenergizing the second primary winding LP2. For this purpose, the control circuit 20 triggers a pulse width modulated ON/OFF sequence that will activate SW2 accordingly, as shown in FIG. 2. In consequence, the second primary LP2 is fed with current out of the battery and at the output circuit a voltage is induced according to the winding ratio of LP2 and LSEC. The ON/OFF time sequence of SW2 is advantageously set such that the OFF time is short enough to sustain the spark from OFF-state to ON-state of switch SW2. In practice, the OFF-time may be between 5 and 50 μs. The ON-time of the switch SW2 is preferably set such that an acceptable efficient energy transfer occurs from LP1 to LSEC and into the spark-plug 14. The ON-time may vary between 5 and 500 μs. In this second phase energy is further pushed in the initial arc and even after; therefore, ISEC_TH is preferably non-null. If desired, the ON and OFF-times may be varied dynamically during a single ignition event, for example to vary the distribution of energy.

It may be noticed that during the OFF-time of SW2, the spark itself is maintained by the presence of the charged output circuit capacitance 24 parallel to the spark plug (natural capacitive behavior of the secondary winding LSEC), as well as by the residual room charges and transient afterglow. The OFF-time is thus preferably set to be shorter than the afterglow. The activation of SW2 is preferably limited by a dedicated enable signal (EN).

As illustrated in FIG. 2, the PWM of the second phase may be conditioned by the generation of an enabling signal (EN) in the control circuit 20 (when the threshold condition ISEC_TH is met). The second phase preferably has a calibrated length (e.g. mapped versus engine combustion modes). At the end of the second phase, the control circuit 20 cancels the PWM enabling signal (EN), which marks the end of the ignition event for the respective combustion cycle. This enabling signal EN limits the dissipated heat inside the electronics and transformer 12 and determines the start and stop of this boosting through LP2 and LSEC (second phase).

The principle of the present ignition event is thus globally summarized in FIG. 2, where it can readily be seen that for one ignition cycle, corresponding to the spark required for one combustion event, the ignition event consists of the initial phase during which the primary winding undergoes only one charge/discharge, followed by the second phase (starting when the threshold on ISEC is met) during which the second winding undergoes a plurality of charges/discharges cycles. As explained above, the initial phase is designed to provide a spark immediately after the electrical beak-down. In the second phase, the idea is to transfer energy into the secondary winding LSEC to sustain the burn phase. Energy is transferred during the ON-state of SW2, i.e. when current actually flows through the second primary.

Figure 3:
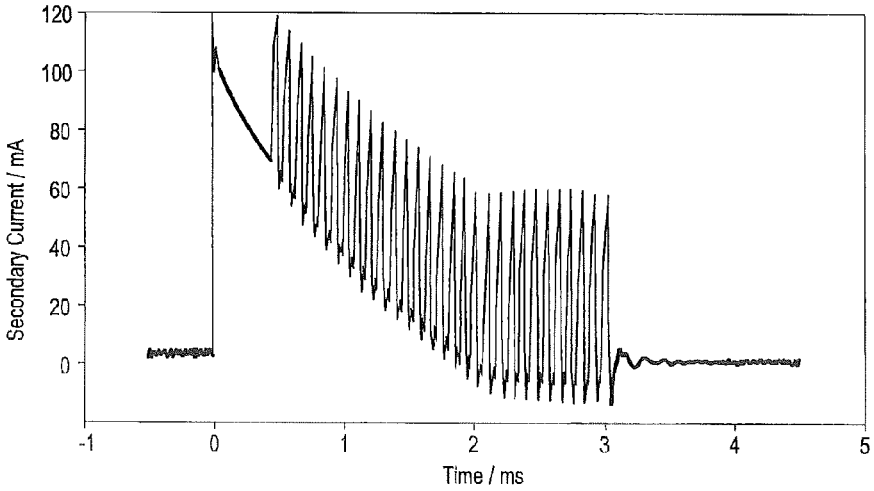
FIG. 3: is a trace diagram of the current in the secondary winding during one ignition event.

It shall be appreciated that the present system, operated as explained above, provides a uni-polar current ISEC allowing a continuous burn phase. The resulting shape of this uni-polar secondary current ISEC is shown in FIG. 3. One will recognize the typical decaying current discharge characteristic originated by the first primary LP1 to the secondary winding LSEC (initial phase), with the superposition of the second primary LP2 originated by the PWM activation of the switch SW2 in the second phase (starting with the second peak). It should be noticed that, as explained above, the current peaks of the second phase correspond to ON-times of switch SW2,—In the example of FIG. 3, the continuous burn phase starts after t=2 ms and the spark stops at about t=3 ms (end of enabling signal EN). The total duration of the ignition event may generally be limited by the ability of the ignition system to dissipate the thermal losses.

Figure 4:
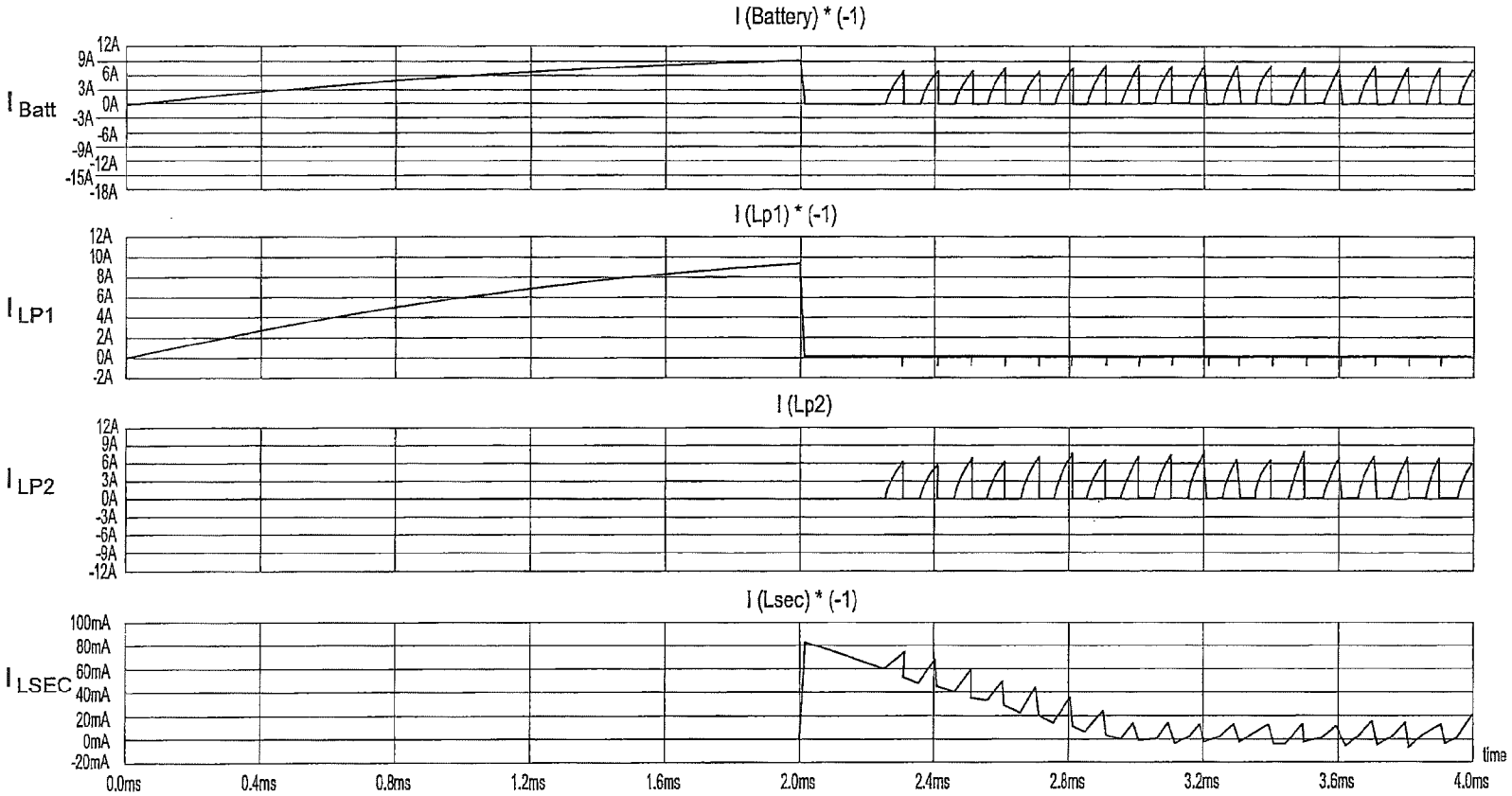
FIG. 4: shows the battery current and the current traces in the 3 windings of the ignition coil during an ignition event.

FIG. 4 shows another example of the present ignition procedure, with the current traces in the battery IBatt, in the first primary winding ILP1, in the second primary winding ILP2 and in the secondary ISEC. Here again, one can readily identify a uni-polar current, with the superposition of the energy forced into the secondary winding LSEC by means of the second primary winding ILP2, and the extended burn phase.

The output circuit is advantageously protected against early make by a diode 22 in series with the secondary LSEC. The use of such diode 22 in the output is rendered possible since the output current ISEC is uni-polar.

Another possible protection measure is the use of diodes D1 and D2 (FIG. 1) in order to block reverse current. Because of the magnetic coupling K of the transformer 12, notable current is induced during the individual transfers not only into LSEC but also into the opposing primary, creating additional losses and moreover a reverse current though the semiconductor switches SW1 and SW2. Such reverse current can be blocked by means of the series Diodes D1 and D2, while keeping the existing switches. Alternatively, switching elements with intrinsic reverse blocking properties can be used for the switches SW1 and SW2.

As it will be understood, when the stored energy in Lp1 is discharged as a result of the first electric arc, while the switch SW2 is switched on during the subsequent second phase, the magnetic circuit is charged by coil Lp2 in an opposite direction, when the electrical load—represented by the ignition spark—is getting high ohmic. Depending on the circumstances, there is a risk that a subsequent switching off of SW2 would generate a high voltage at the diode 22 in reverse direction and that the diode 22 breaks through in reverse direction.

For the protection of the HV-Diode, the control unit is preferably configured to switch SW2 off (and hence interrupt the current flow through Lp2) before the magnetic circuit is completely discharged. An indication for the stored energy in the transformer is the secondary current or any parameter function or indicative thereof, e.g. the voltage at the diode. In practice, the secondary current may be monitored and when it reaches a minimum switch off value referred to as safety threshold, SW2 is switched off. And the ignition event is then finished. For conventional diodes, the safety threshold may, e.g., be in the range of 0 to +15 mA, preferably between 0 and 10 mA.

In the context of the electric design of FIG. 1, another indicator of the energy level stored in the transformer may be the collector voltage of the IGBT switch SW2.

As a further possible implementation, incoming and outgoing energies may be computed for the transformer, and the switch SW2 may be turned off when a safety energy threshold is undershot.

The invention claimed is:

1. An ignition system for an internal combustion engine comprising:

a pair of gapped electrodes;

a secondary winding having a pair of output terminals coupled to the gapped electrodes;

a first primary winding inductively coupled to the secondary winding;

a second primary winding inductively coupled to the secondary winding;

a diode in series with said secondary winding and one of said gapped electrodes;

wherein said ignition system is designed to generate, for a given ignition event, a current through said secondary winding by way of a control circuit that is configured to:

in an initial phase, first energize and deenergize the first primary winding to establish a first electrical arc across the gapped electrodes and, when the current in the secondary winding reaches, or drops below, a current threshold; and in a second phase repeatedly energizes and deenergizes the second primary winding to establish a plurality of second current pulses across the gapped electrodes in order to maintain the burn phase;

wherein for a given ignition event the first primary winding is only energized and deenergized once in order to establish the first electrical arc, the burn phase being subsequently maintained by two or more current pulses operated at the second primary winding during the second phase.

2. The ignition system according to claim 1, wherein the current generated through said secondary winding during an ignition event is uni-polar.

3. The ignition system according to claim 1, comprising a current measuring shunt in series with said secondary winding.

4. The ignition system according to claim 1, wherein the turns ratio of the secondary winding to the second primary winding is larger than 150.

5. The ignition system according to claim 1, wherein the turns ratio of the secondary winding to the first primary winding is in the range of 50 to 200.

6. The ignition system according to claim 1, wherein the turns ratio of the secondary winding to the second primary winding is greater than the turns ratio of the secondary winding to the first primary winding.

7. The ignition system according to claim 1, wherein the repeated energizing and deenergizing of the second primary winding is driven by a pulse width modulation signal.

8. The ignition system according to claim 7, wherein at least one of 1) said pulse width modulation signal is triggered when said secondary current meets said current threshold and 2) said pulse width modulation signal has a calibrated duration.

9. The ignition system according to claim 7, wherein at least on of 1) said pulse width modulated signal has an ON-time of between 5 and 500 μs; and 2) said pulse width modulated signal has an OFF-time of between 5 and 50 μs.

10. The ignition system according to claim 1, comprising a first switching device associated with the first primary winding and a second switching device associated with the second primary winding such that the first switching device and the second switching device are controlled by said control circuit.

11. The ignition system according to claim 10, comprising a reverse current protection diode in series with each of said switches.

12. The ignition system according to claim 1, comprising one first primary winding and one second primary winding.

13. The ignition system according to claim 1, wherein said control unit is configured to terminate said second phase in case, while said second primary winding is being energized, the energy level in said secondary winding reaches or drops below a predetermined safety threshold.

14. The ignition system according to claim 13, wherein said second phase is terminated when the current in the secondary winding reaches or drops below a predetermined safety current threshold.

15. A method of providing ignition to an internal combustion engine, said engine comprising an ignition system having an ignition coil with two primary windings inductively coupled to a secondary winding and a diode in series with said secondary winding, said method comprising:

operating an initial phase to provide an initial spark by establishing a primary current through said first primary winding and interrupting said primary current to thereby generate a secondary current in said secondary winding magnetically coupled to said first primary winding;

operating a second phase, following said initial phase, to allow a continuous burn by repeatedly energizing and deenergizing said second primary winding magnetically coupled to said secondary winding;

wherein the secondary phase is started when the current through said secondary winding meets a current threshold.

16. The method according to claim 15, wherein a current of same polarity flows in the secondary winding during said initial phase and said second phase.

17. The method according to claim 15, wherein said second phase is terminated in case, while said second primary winding is being energized, the energy level in said secondary winding reaches or drops below a predetermined safety threshold.

18. The ignition system according to claim 4, wherein the turns ratio of the secondary winding to the second primary winding is between 200 to 500.

* * * * *